US007143667B2

(12) United States Patent
Deros et al.

(10) Patent No.: US 7,143,667 B2
(45) Date of Patent: Dec. 5, 2006

(54) STRIKING OR PULLING TOOL WITH A SPLIT HEAD

(75) Inventors: Yani Deros, Phoenix, AZ (US); Thomas H. Turner, Nashua, NH (US)

(73) Assignee: Atom design Inc., Phoenix, AZ (US)

( * ) Notice: Subject to any disclaimer, the term of this patent is extended or adjusted under 35 U.S.C. 154(b) by 34 days.

(21) Appl. No.: 10/902,366

(22) Filed: Jul. 29, 2004

(65) Prior Publication Data

US 2006/0021473 A1 Feb. 2, 2006

(51) Int. Cl.
*B25D 1/00* (2006.01)
*B25D 1/12* (2006.01)

(52) U.S. Cl. ..... 81/20; 254/26 R; 81/22

(58) Field of Classification Search ..... 81/20, 81/22, 26, 25; 254/26 E, 26 R
See application file for complete search history.

(56) References Cited

U.S. PATENT DOCUMENTS

| | | | | |
|---|---|---|---|---|
| 378,650 | A | 2/1888 | Bigelow | |
| 967,703 | A | 8/1910 | Bagnall | |
| 1,111,277 | A | 9/1914 | Trainor | |
| 1,410,407 | A * | 3/1922 | Luttrell | 254/26 R |
| 1,643,861 | A * | 9/1927 | Szakacs | 30/308.1 |
| 1,781,344 | A * | 11/1930 | Salazar | 81/22 |
| 2,754,863 | A * | 7/1956 | Yearley | 81/22 |
| 3,677,187 | A * | 7/1972 | Stewart | 104/10 |
| 4,393,908 | A | 7/1983 | Clay | |
| 4,433,709 | A | 2/1984 | Porter | |
| 4,658,679 | A | 4/1987 | Nitzberg et al. | |
| 5,012,702 | A | 5/1991 | Taylor | |
| 5,123,303 | A | 6/1992 | Lee et al. | |
| 5,408,902 | A | 4/1995 | Burnett | |
| 5,537,896 | A * | 7/1996 | Halder | 81/26 |
| 5,730,059 | A | 3/1998 | Sandsted et al. | |
| 6,339,974 | B1 | 1/2002 | Kotschner et al. | |
| 2006/0021473 | A1* | 2/2006 | Deros et al. | 81/20 |

FOREIGN PATENT DOCUMENTS

| | | |
|---|---|---|
| DE | 296 17 430 U 1 | 11/1996 |
| DE | 196 05 676 A 1 | 8/1997 |

* cited by examiner

*Primary Examiner*—Lee D. Wilson
(74) *Attorney, Agent, or Firm*—Marian J. Furst, Attorney at Law; Marian J. Furst

(57) ABSTRACT

A striking and pulling tool, such as a hammer, having separate head elements secured to opposing sides of a handle. The tool may be part of a system with interchangeable components.

26 Claims, 10 Drawing Sheets

STRIKING OR PULLING TOOL WITH A SPLIT HEAD

FIELD OF THE INVENTION

The present invention relates generally to striking and pulling tools having a handle and two head portions mounted to the handle, and more particularly to a hammer having two head elements attached to a handle.

BACKGROUND OF THE INVENTION

Traditional hammers have a head with two functional ends, such as a strike face for striking nails into and a claw end for pulling nails out of a work piece, and the head is attached to a handle. Commonly, one end of the handle extends through an eye in the head, and a wedge is forced into the end of the handle to expand the handle end, holding it in place against the interior walls of the eye. Usually, the head is forged from steel, and the handle is wood. Such hammers have been in use for many years, and the manufacturing processes are well known.

Even in normal use, these hammers are subject to damage. One of the most common types of failure occurs when the handle fractures, splinters, or breaks just below the hammer head striking face. These failures typically occur when a user misses the intended nail or other target, hitting the target with the handle instead of the hammer strike face. In addition, the handle can be damaged if the claw is used to pull objects, and the objects scrape or impact the handle. Another type of damage occurs when the head chips or cracks during use, either due to impact with a target or due to manufacturing flaws in the steel or other metal. If the handle is damaged, it can be replaced by removing the wedge that secures it in the eye of the head, and installing a new handle and wedge. If the head is damaged, a new head can be installed on the existing handle. Generally the strike face of the hammer head is smooth, and it is common for a smooth head to slip off of the intended target if it is not directed toward the target with the striking force in exactly the correct direction.

One solution to the problem of damage to the hammer handle from overstriking and/or impacts with pulled objects is shown in FIG. 1. The head 10 is mounted to the handle 12 in the conventional manner, and metallic strips 14 are fastened to the handle 12 below the head 10 using screws 16. Another solution, shown in FIG. 2, provides another way to prevent damage to the handle. Head 20 includes a metallic plate or spine extending into a slot in handle 22, with protector 24 fitting against the outer surface of handle 22 and covering the slot. Fasteners 26 extend through handle 22 and the plate that extends into the slot in the handle.

Other hammers have been devised with the metallic head and handle forged or cast as a single piece, usually with a resilient textured grip around the end of the handle that is distal from the head to absorb shock and make the handle less slippery and easier for the user to hold onto. While this type of hammer is more resistant to damage from overstriking targets, its single-piece metal head/handle transmits more vibration and impact from the head to the user's hand, which tends to cause fatigue for the user. Thus, this type of hammer is generally not ideal for professional or other heavy duty use.

A more recent type of hammer is illustrated in FIG. 3. The hammer head 30 is forged or cast with a spine or neck 32 that extends into the handle 34. The head 30 includes claw 36 and an opening 38. A strike face 40 is fastened to the head

30, such as with a bolt 42 extending from opening 38 through a hole (not shown) in head 30 and into a threaded hole (not shown) extending into but not all the way through strike face 40. Strike face 40 can be easily replaced if it is damaged, such as by chipping during use.

SUMMARY OF THE INVENTION

In accordance with the purpose of the present invention broadly described herein, one embodiment of this invention comprises a tool for striking objects into a workpiece or pulling objects from a workpiece. The tool has a handle with a distal end, a proximal end, and at least one hole passing through the proximal end. The hole is sized and positioned to accommodate a fastening means. The tool also includes a split head comprising two head elements on opposing sides of the proximal end of the handle, with each head element having at least one aperture therein. Each head element aperture is aligned with a hole passing through the handle. In addition, the tool includes fastening means passing between the apertures in the head elements and through the hole in the handle. The fastening means secure the head elements to each other and to the proximal end of the handle.

The head elements of the tool may have dimensions selected for a desired type of task. If the tool is a hammer, at least one of the head elements may comprise a strike face, and one of the elements may comprise a claw. Preferably the head elements and the handle have a smooth, rounded external profile. Further, at least one of the head elements may comprise an integrated overstrike plate adjacent the proximal end of the handle and extending along the handle toward the distal end. The head elements may be removable and separately replaceable. Further, the head elements may be matched to provide a desirable weight distribution. In addition, the tool may comprise at least one shock absorbing element between one of the head elements and the proximal end of the handle. The shock absorbing element may comprise a substantially resilient material, which may comprise a material selected from single durometer materials, variable durometer materials, dual durometer materials, multi-durometer materials, and combinations thereof. Also, the head elements, the shock absorbing elements, and the handle may have a smooth external profile. The tool may additionally comprise at least one weighting element between one of the head elements and the proximal end of the handle. The fastening means may be selected from screws, nuts, bolts, washers, torque screws, torque nuts, rivets, rivetless fasteners, internally threaded sleeves, welded pins, and combinations thereof.

Another embodiment of the present invention comprises a head element for a tool for striking objects into a workpiece or pulling objects from a workpiece. The head element comprises a striking or pulling means and a surface shaped to fit against a handle. It also includes an integral overstrike plate shaped to fit against the handle and at least one opening in the overstrike plate to accommodate a fastener for securing the head element to another head element on an opposing side of the handle. The head element may be selected from nail striking elements, mallet elements, and claw elements. Further, it may include a substantially planar or contoured strike face, and the strike face may have a textured surface.

Yet another embodiment of the present invention comprises a striking and pulling tool system. The system includes at least one handle, and each handle has a distal end and a proximal end. At least one hole passes through the proximal end of each handle for accommodating fastening means extending through the handle. The system also comprises a plurality of head elements. Each head element is sized and shaped to fit against the proximal end of the handle opposing another of the head elements. There is at least one aperture in each head element. The apertures are positioned for alignment with a hole passing through the handle. Further, the system comprises fastening means for insertion through the at least one hole the handle and into the apertures in two of the head elements to secure the head elements to each other on opposing sides of the handle. Each of the head elements may be designed for a different use. The system also includes fastening means for insertion through holes in the handle and securing the head elements to each other on opposing sides of the handle. At least some of the head elements may comprise integrated overstrike plates. Also, the tool system may comprise a plurality of shock absorbing elements adapted to be positioned between the head elements and the handle. The tool system may comprise a plurality of sets of paired head elements, wherein each pair of head elements has a complementary weight distribution. The paired head elements may have shapes and sizes selected for a desired type of task.

BRIEF DESCRIPTION OF THE DRAWINGS

These and other features, aspects, and advantages of the present invention will become better understood with reference to the following description, appended claims, and accompanying drawings, where:

DESCRIPTION OF THE INVENTION

A striking or pulling tool in accordance with the present invention includes two head elements that are secured onto opposing sides of a handle. In this novel tool, separate head elements, for example, a hammer head and a claw, are secured to the handle. They may be removably secured in such a way as to facilitate use of a variety of interchangeable parts for different applications and also easy replacement of damaged head elements and handles. The combination of a handle and the head elements could also be assembled to form other types of tools that traditionally have had a head mounted to the end of a handle, such as mallets, picks, axes, hatchets, ice axes, and the like.

Figure 1:
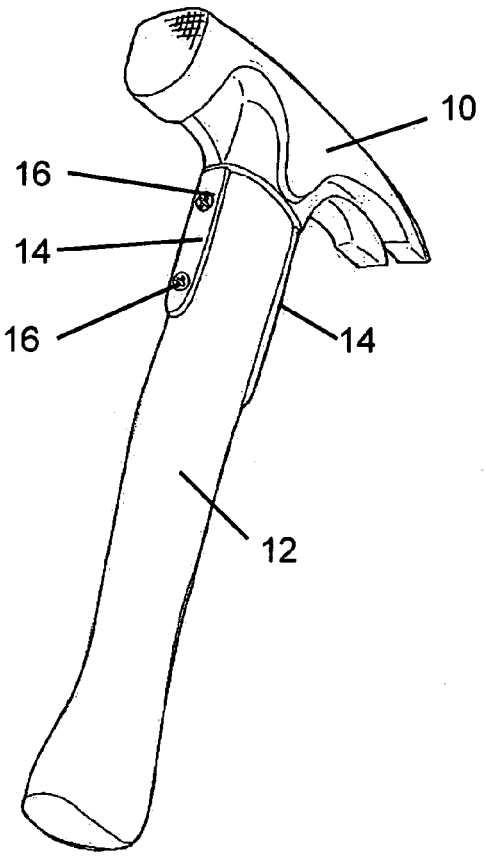
Fig. 1 (prior art)
FIG. 1 is a perspective view of a prior art hammer.
Figure 2:
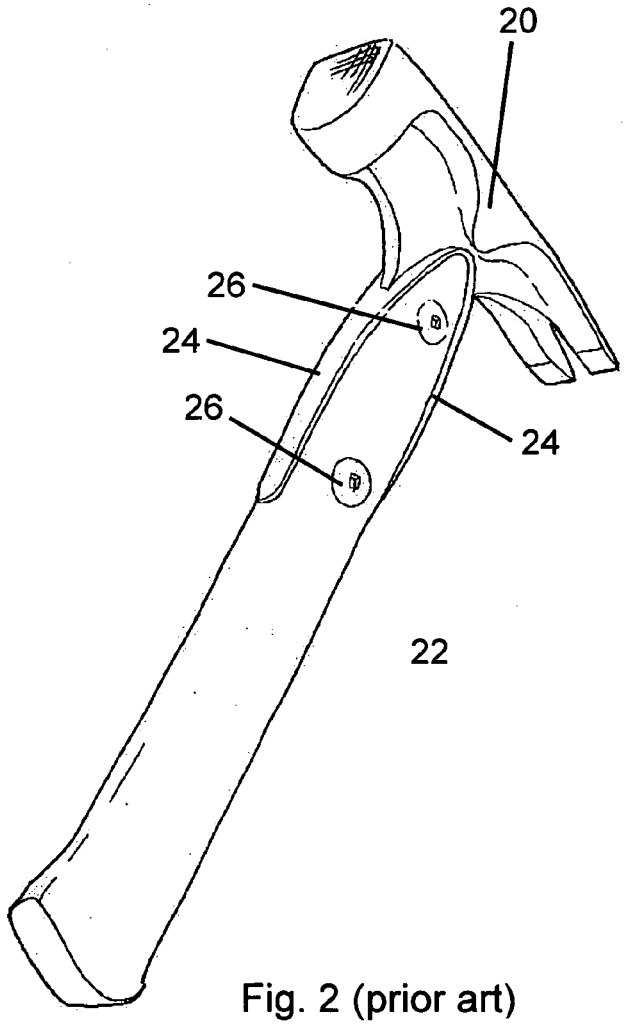
Fig. 2 (prior art)
FIG. 2 is a perspective view of another prior art hammer.
Figure 3:
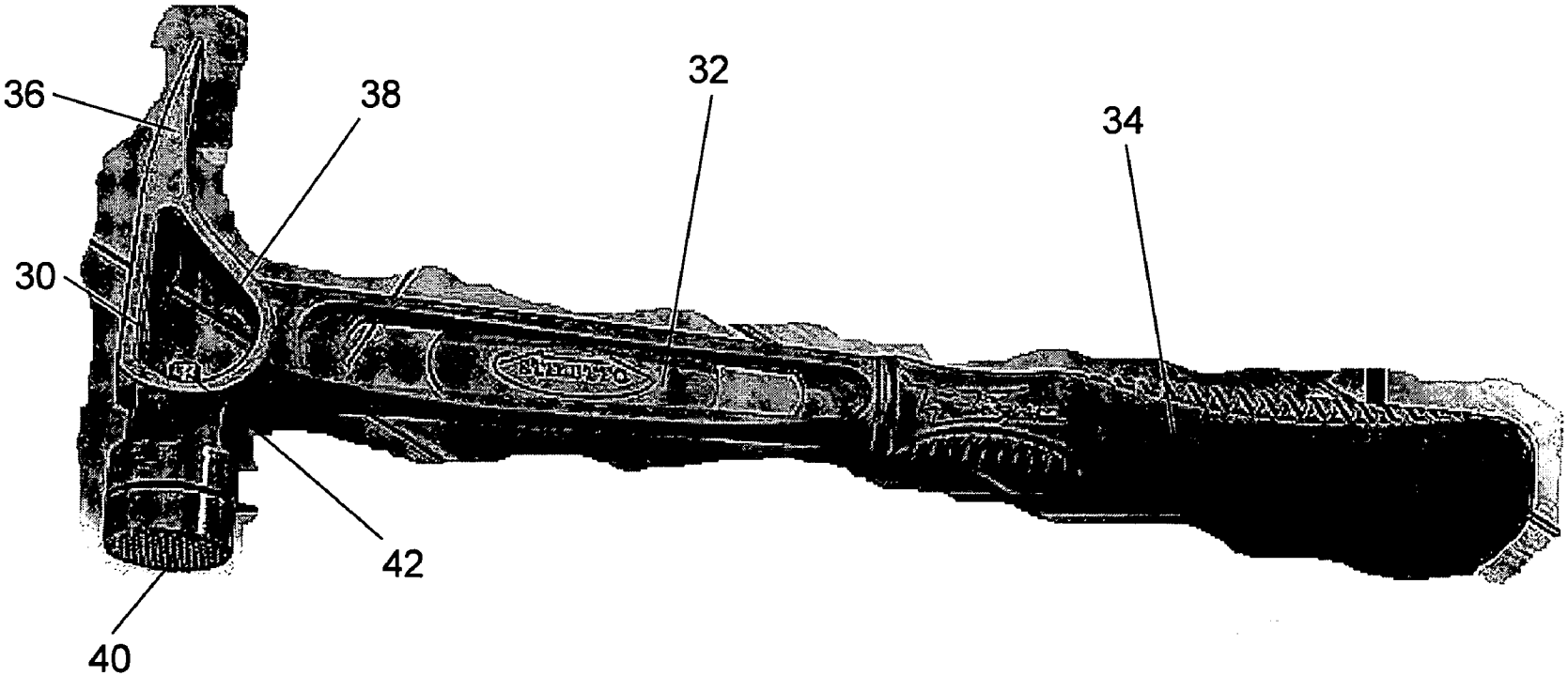
Fig. 3 (prior art)
FIG. 3 is a perspective view of another prior art hammer.
Figure 4:
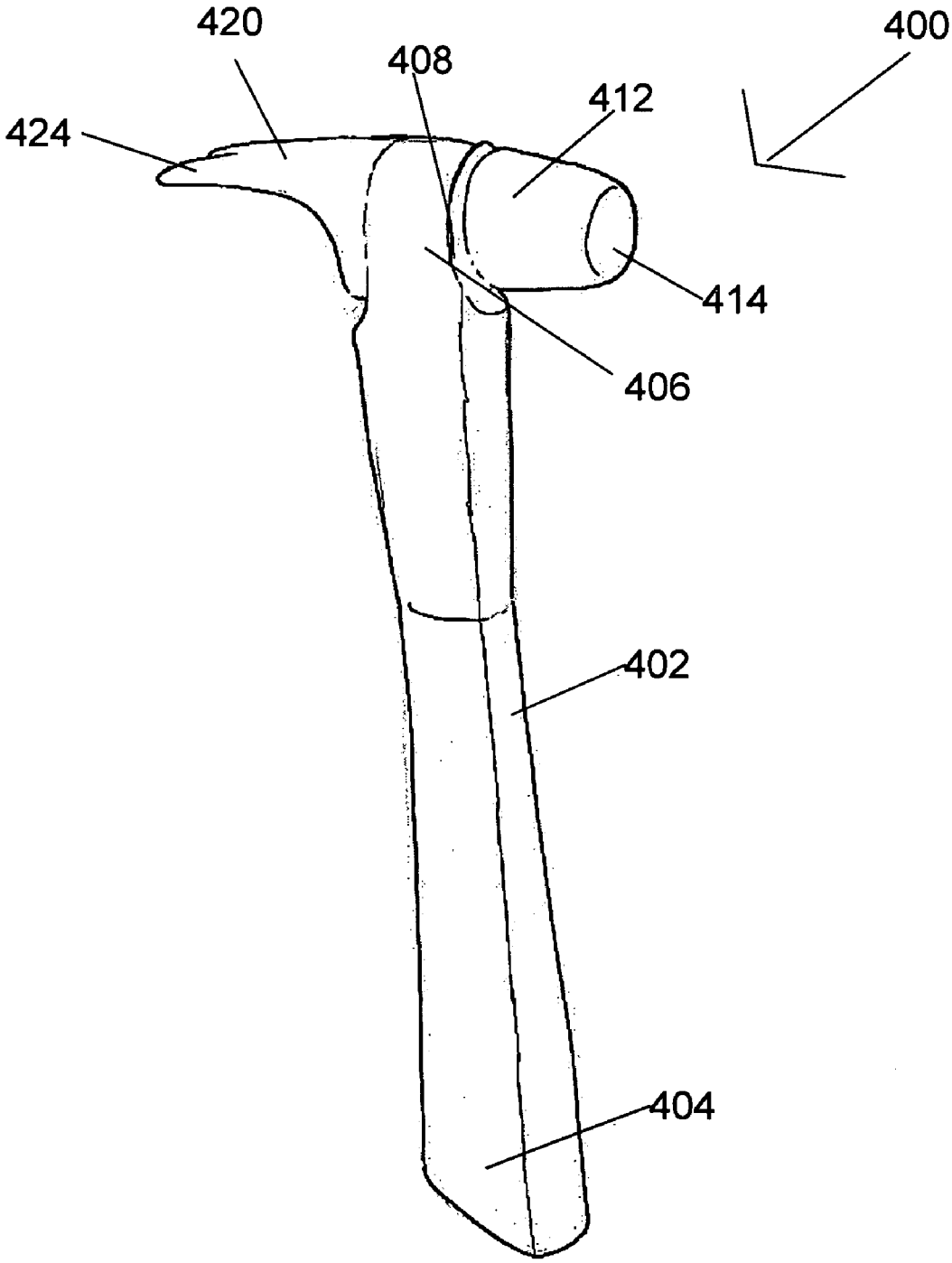
FIG. 4 is a perspective view of a hammer in accordance with one embodiment of the present invention.
Figure 5:
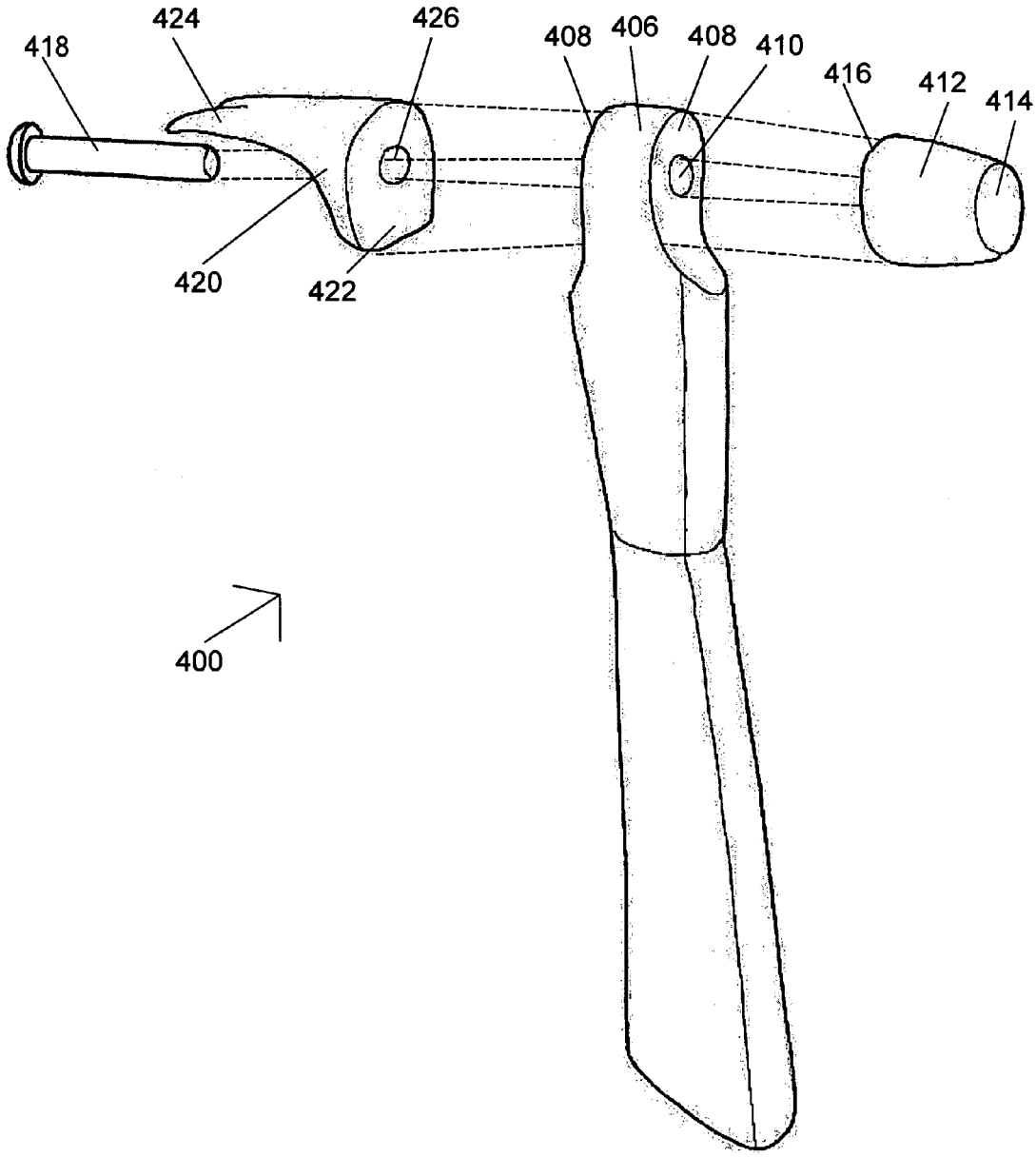
FIG. 5 is an exploded perspective view of the embodiment of FIG. 4.

Referring to FIGS. 4 and 5, in one embodiment of the present invention, hammer 400 includes a handle 402 with a distal gripping end 404 and a proximal head end 406. The head end 406 includes two opposing faces 408, and a hole 410 extends through head end 406 between faces 408. A first head element 412 has a substantially planar strike face 414, a mounting face 416, and a threaded opening (not shown) in mounting face 416. Head element 412 preferably has a size, shape, and weight distribution so as to be suitable for striking objects, such as nails, pegs, or other objects into work pieces. A second head element 420 includes a mounting face 422 and a claw 424 for gripping a nail or other fastener about the fastener shank. A hole 426 extends through head element 420. Preferably, mounting faces 416 and 422 are formed to fit flush against opposing faces 408 of handle 402 and the holes in the head element 420 and in the handle 402 are positioned so that they align with each other and with threaded fastener 418. Preferably, holes 410, 426, and the hole in head element 412 are sized to accommodate the diameter of fastener 418 when fastener 418 is inserted into them.

Referring to FIGS. 6–9, hammer 600 has a curved handle 602 with a distal gripping end 604 and a proximal head end 606. Holes 608 extend through head end 606 between opposing faces 610 and 612. Head element 620 includes a strike face 622, an overstrike plate 624, and a mounting face 626. Threaded holes (not shown) extend from mounting face 626 into the interior of head element 620. Strike face 622 is substantially planar, and it preferably has a textured striking surface. The top of head element 620 includes a recess 628 with a magnetized insert 630 for holding a tack or nail while preparing to hammer it into a work piece. A second head element 640 includes a mounting face 642, an overstrike plate 644, and claw 646. Holes 648 extend through head element 640 below claw 646. Shock absorbing element 650 is positioned between mounting face 626 of head element 620 and face 610 of the handle 602, and shock absorbing element 660 is positioned between mounting face 642 and handle face 612. The shock absorbing elements are formed from a vibration and shock absorbing material and include holes 652 and 662. Threaded fasteners 670, such as torque screws or bolts, extend, respectively, through the holes 642 in second head element 640, holes 662 in shock absorbing element 660, holes 608 in handle 602, holes 652 in shock absorbing element 650, and are engaged into threaded holes (not shown) in first head element 620. Thus, the holes in the head elements, shock absorbing elements, and handle are positioned so that the respective head elements, shock absorbing elements, and handle are aligned with each other, with the shock absorbing elements engaged between the head element mounting faces and the faces of the handle. Preferably, the holes in the second head element, shock absorbing elements, and handle are sized to accommodate the diameters of fasteners 670 without binding when fasteners 670 are inserted into the holes. An alternative configuration could be used, with threaded holes extending into the claw head element and fasteners inserted through the striking head element and the handle.

The overstrike plates 624 and 644 are integral with head elements 620 and 640, respectively, and they extend along the handle 602 toward the gripping end 604 of the handle and protect the handle from damage when the strike face 622 misses the intended target due to an overstrike or when the claw 646 is used to pull work pieces. In comparison with conventional hammers, the hammer of this embodiment has increased strength because the end of the handle is not split longitudinally to accommodate a wedge for securing a single-piece head to the handle and because the head elements are fastened to the handle at multiple locations along the handle. Further, the integral overstrike plates distribute strike forces and pull loads along a greater portion of the handle, thereby decreasing the localized stresses that can cause handle failure.

Figure 12:
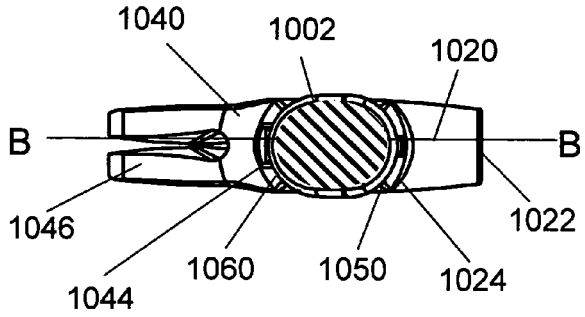
FIG. 12 is a cross sectional view of the hammer of FIG. 10 through the handle below the head, along plane A—A.

Another embodiment of a hammer in accordance with the present invention can be understood with reference to FIGS. 10–13. Hammer 1000 includes a straight handle 1002, head elements 1020 and 1040, and shock absorbing elements 1050 and 1060. As shown in FIG. 12, handle 1002 has a rounded cross section perpendicular to its long dimension, and head elements 1020 and 1040 and shock absorbing elements 1050 and 1060 have curved surfaces that fit against handle 1002. Head element 1020 has a strike face 1022, a recess 1028 for holding and positioning nails, and an overstrike plate 1024. Threaded holes 1032 extend partially through head element 1020 to accommodate the ends of threaded fasteners 1070. Shock absorbing element 1050 is positioned between handle 1002 and head element 1020. Head element 1040 includes a claw 1046 and an overstrike plate 1044. Shock absorbing element 1060 is positioned between head element 1040 and the proximal end of handle 1002. Holes 1048 in head element 1040, holes 1062 in shock absorbing element 1060, holes 1008 in handle 1002, and holes 1052 in shock absorbing element 1050 are sized to accommodate fasteners 1070 and are aligned with holes 1032 in head element 1020.

Figures 6, 7:
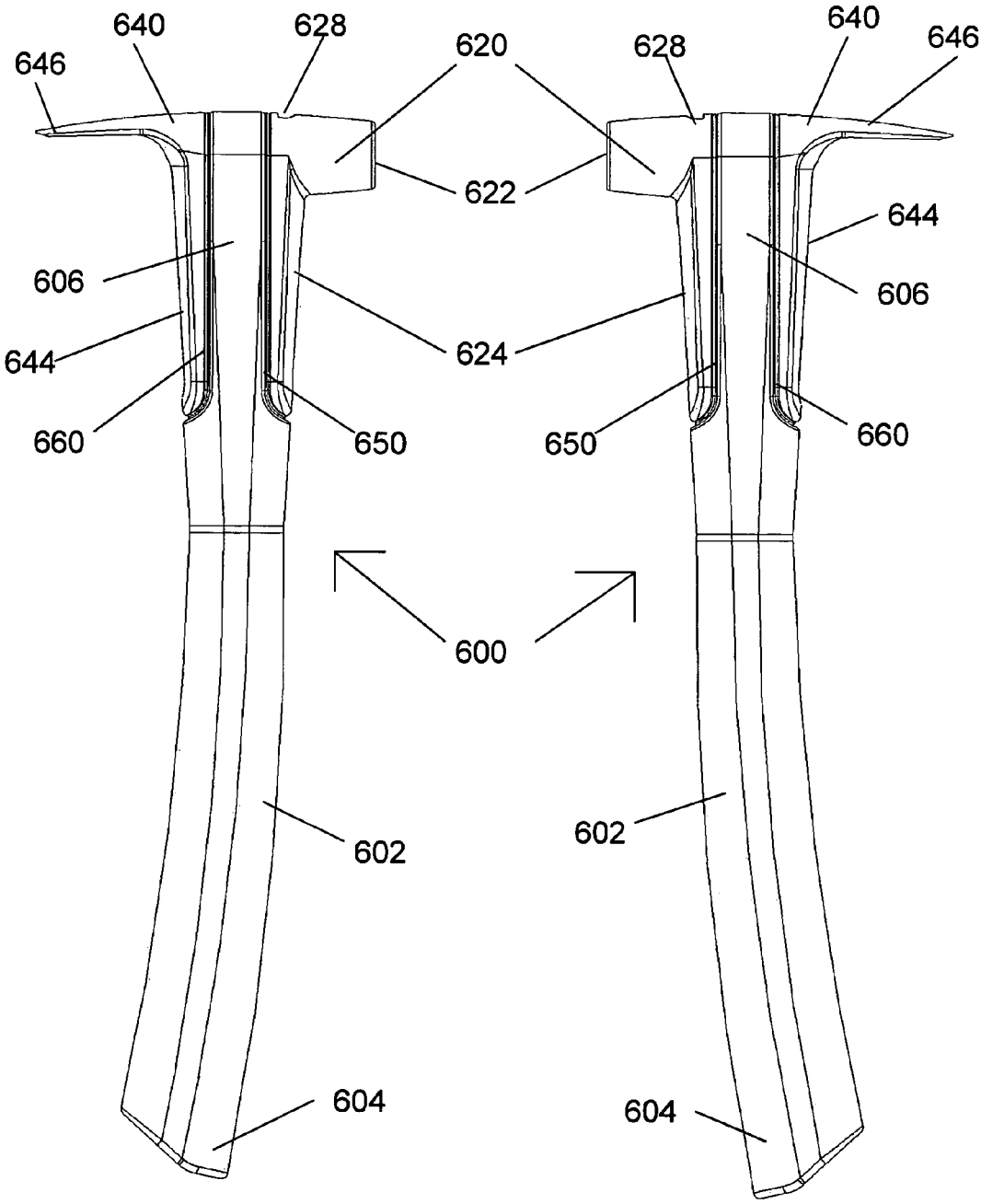
FIG. 6 is a side view of a hammer in accordance with another embodiment of the present invention.
FIG. 7 is a side view showing the opposing side of the hammer of FIG. 6.
Figure 8:
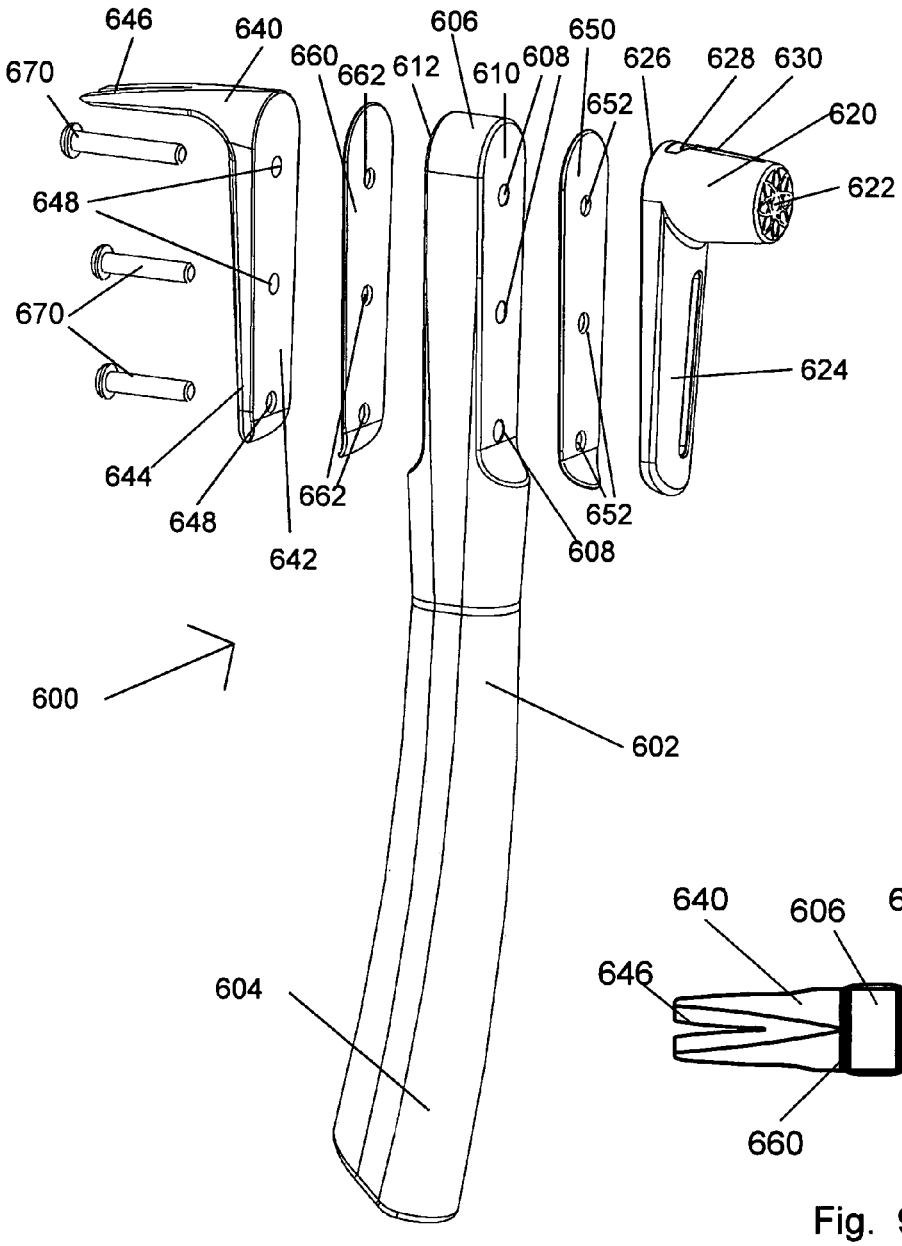
FIG. 8 is an exploded perspective view of the hammer of FIG. 6.
Figure 9:
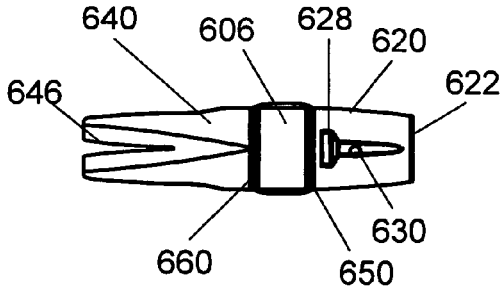
FIG. 9 is a top view of the hammer and head of FIG. 6.
Figure 10:
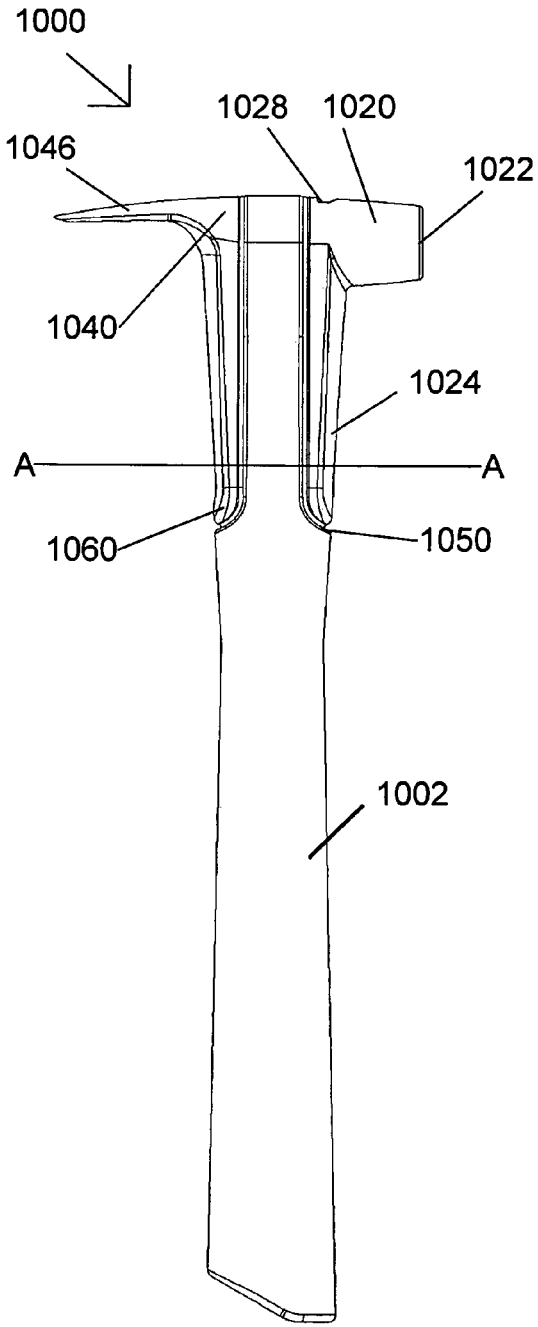
FIG. 10 is a side view of a hammer in accordance with yet another embodiment of the present invention.
Figure 11:
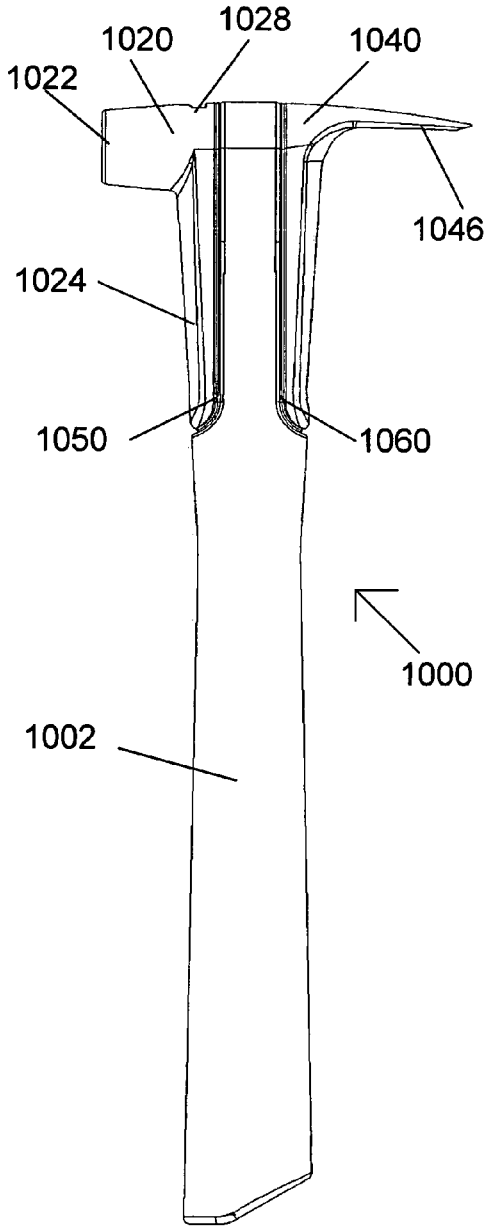
FIG. 11 is a side view showing the opposing side of the hammer of FIG. 10.

The handle of a tool in accordance with the present invention can be straight, as shown in FIGS. 4–5 and 10–13. Alternatively, it can be curved, as shown in FIGS. 6–8, so that the user's hand does not impact the work pieces with which the hammer is used to insert or remove nails, pegs, or the like. The handle can be formed from any suitable material with sufficient stiffness, shock absorption, and durability. Preferably, the handle is formed from wood or a composite material. The gripping end of the handle may be adapted for a comfortable, secure grip by user, such as by covering the gripping end with a material that is textured or resilient, or by shaping the handle for accommodation to the user's hand. Preferably, the opposing faces against which the head element are mounted are substantially identical in size and shape to accommodate interchangeable head elements. The handle dimensions may be selected such that they are appropriate for the intended use of the tool.

Figure 14:
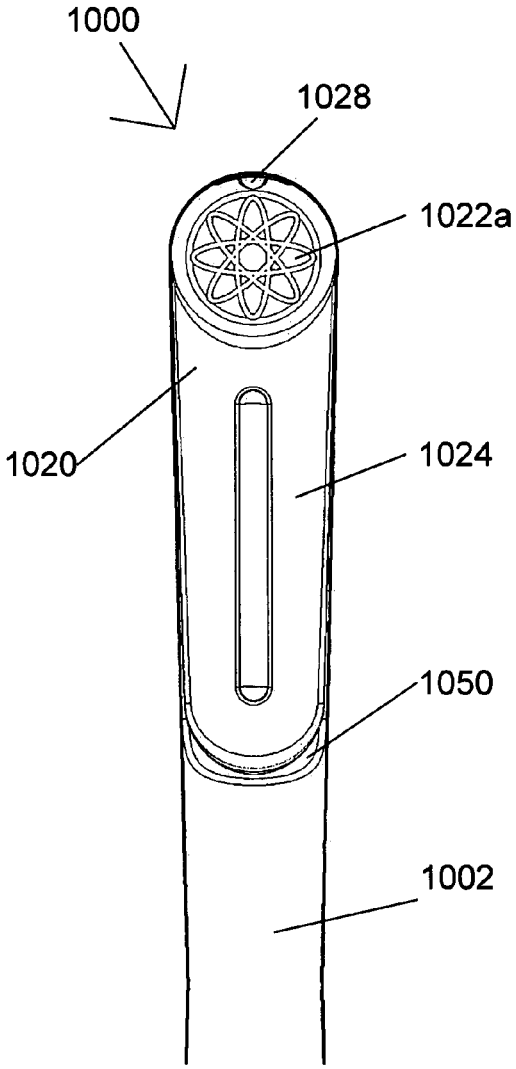
FIG. 14 is a front view of a hammer head element of FIG. 10 showing one embodiment of a strike face.
Figure 15:
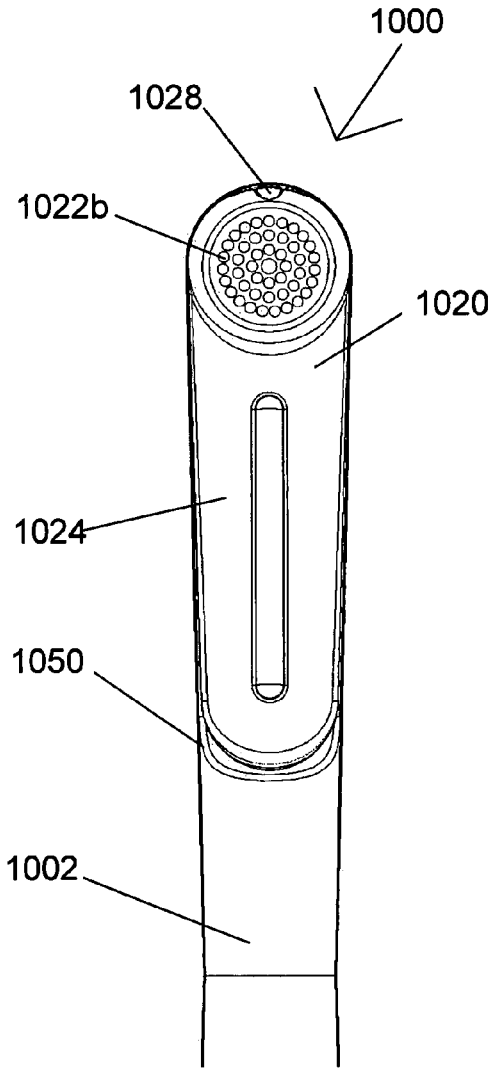
FIG. 15 is a front view of the hammer head element of FIG. 10 showing another embodiment of a strike face.

The head elements can be formed from any suitable hard, impact resistant material. Preferably, they are formed from forged or cast metal without significant flaws that would lead to excessive cracking and/or chipping. The head elements can have any of a variety of shapes and sizes suitable for their intended use. For example, a head element may have a flat strike face, shown as 414 in FIGS. 4 and 5, for pounding nails and the like. Preferably, the strike face will have a textured surface, such as strike face 622 shown in FIG. 8 or strike faces 1022*a* and 1022*b*, shown in FIG. 14 or 15. The texture increases traction with the objects to be pounded with the strike face, and it may be imparted to the face during a casting or forging process, or it can be applied later, such as by cutting, etching, or any other method known in the art for texturing metal surfaces. The texture may be a faceted geometric knurling pattern. It may be decorative or include indicia such as a logo or other commercial mark, shown as 1022*a* in FIG. 14, or it may incorporate a geometric pattern, such as the concentric rings of circles shown as 1022*b* in FIG. 15.

Figure 16:
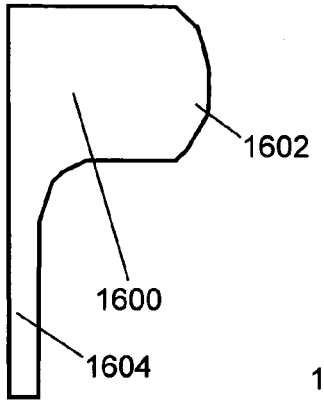
FIG. 16 is a side view of one type of head element in accordance with the present invention.
Figure 17:
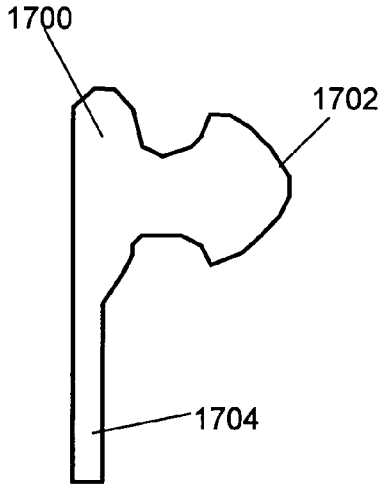
FIG. 17 is a side view of another type of head element in accordance with the present invention.
Figure 18:
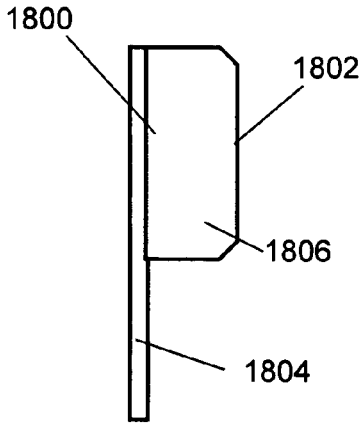
FIG. 18 is a side view of yet another type of head element in accordance with the present invention.
Figure 19:
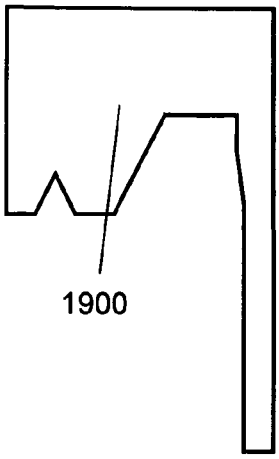
FIG. 19 is a side view of still another type of head element in accordance with the present invention.
Figure 20:
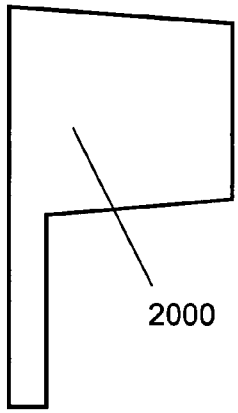
FIG. 20 is a side view of another type of head element in accordance with the present invention.

Other types of head elements are possible. For example, a head element may have a curved claw suitable for framing carpentry, shown as claw 424 in FIGS. 4–5, or a straight claw suitable for finish carpentry, shown as 646 in FIGS. 6–10. Referring to FIG. 16, head element 1600 has an overstrike plate 604 and a slightly convex strike face 1602. Head element 1700 has a more rounded strike face 1702, such as for hammering metal work pieces, and an overstrike plate 1604, as shown in FIG. 17. Head element 1800 is a mallet head, with a larger strike face 1802 and an overstrike plate 1804. The mallet head 1800 or its striking portion 1806 may be formed of a somewhat resilient material, such as rubber. Other types of head elements may also be formed and used in accordance with the present invention, such as head element 1900 for working with drywall or wallboard, shown in FIG. 19, and sledge hammer head element 2000 in FIG. 20, which might be used where more power is needed, for example, working with masonry or pounding posts and stakes into the ground. Other types of heads, not shown, could also be used. For example, an ice pick and an adze could be mounted to the handle to form an ice axe for mountaineering, or one or more blades could be mounted to a handle to form a hatchet or an axe. Any combination of two head elements and a handle could be used.

Figure 13:
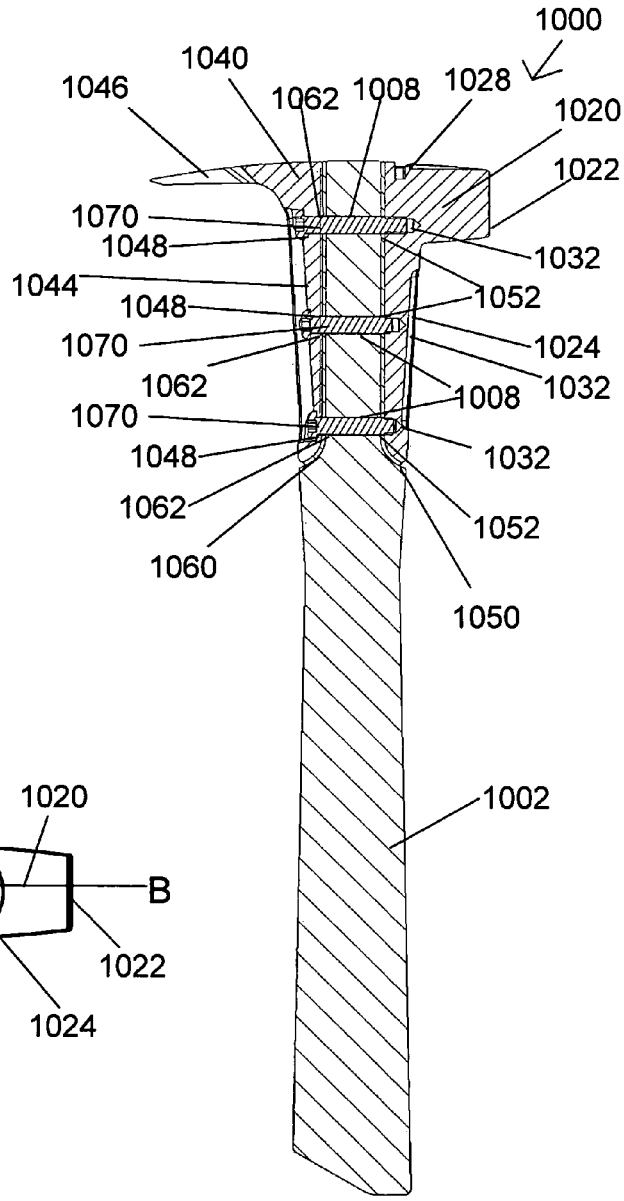
FIG. 13 is a cross section through the hammer of FIG. 10, along plane B—B.

The head elements may have different dimensions as needed. Further, they may be paired or coordinated with each other for proper weighting and balance of the tool assembled with them. If the head elements are paired, one of the elements may have threaded holes to accommodate the ends of fasteners, as shown in FIGS. 5, 8, and 13. If the head elements are not paired, it may be desirable for each head element to have one or more holes extending through the element, and to use a threaded fastener passing completely through each hole with a nut and perhaps also one or more washers to secure the head elements to the handle.

The shock absorbing elements, such as 650 and 660 in FIGS. 6–9 or 1050 and 1060 in FIGS. 10–13, may be formed from any resilient material that will provide damping of vibration and shock absorption. Preferably, the shock absorbing elements comprise a single durometer material, a material having varying durometers, a dual or multi-durometer material, or combinations thereof. The shock absorbing elements reduce or eliminate transfer of shock energy to the handle, thereby lessening the user's hand and arm fatigue. The desired resilience of the shock absorbing elements may change for different users and different tool uses. Thus, shock absorbing elements may have different thicknesses and/or may be formed from different materials with varying resiliencies, and shock absorbing elements may be selected to maximize performance of the tool.

Any suitable fasteners known in the art may be used to secure the head elements to the handle. The fasteners may extend through both head elements and be secured with an external nut, or they may extend into threaded holes in one of the head elements. Although torque screws or bolts are preferred, other types of fasteners, such as rivets and rivetless fasteners may be used. Alternatively, an internally threaded sleeve could be positioned inside each hole in the handle, and screws or bolts could pass from the outside through the holes in the head elements and be engaged with the screw threads in the sleeves. Also alternatively, the heads can be secured to the handle with one or more welded posts within the handle. In this case, the head elements would not be easily interchangeable, however.

It is desirable that the head elements, the shock absorbing elements, the edges of the overstrike plates, and the handle have edges that are flush with each other to form a smooth external profile and prevent snagging and also damage to the surfaces of work pieces with which the tool is used. Particularly if the tool is a hammer is to be used for pulling nails from work pieces, it is desirable that the head elements, the shock absorbing elements, the edges of the overstrike plates, and the end of the handle to which the heads are attached share a rounded profile so that the tool head and claw can be rolled sideways, perpendicular to the long dimension of the claw, to remove nails. These features can be seen in hammers 400, 600, and 1000.

Because the tool of the present invention includes a handle and separate head elements, it is contemplated that either a head element, a shock absorbing element, or a handle that is damaged or fails can be replaced easily. Further, there can be a variety of interchangeable parts suitable for different uses, for example, framing carpentry, finish carpentry, masonry, working with sheet metal, etc. Handles, head elements, and shock absorbing elements can be interchangeable. Because the tool head is separated into two head elements, it is possible to obtain precision weight distribution and balance by combining elements appropriately. If desired, weighting elements can be added to provide the desired weight and balance, particularly if the two head elements are selected from a variety of interchangeable parts. The weighting elements might be in the form of tabular pieces of a heavy metal, such as lead, that would fit between the head element and the handle.

A tool in accordance with the present invention may be assembled or disassembled with reference to FIGS. 5 and 8. A fastener, such as a screw or bolt, is integral with one head element or is inserted through a hole in one head element. The fastener is then inserted through corresponding holes in an optional shock absorbing element, the handle, and a second optional shock absorbing element. The fastener is secured by engagement with threads in a corresponding threaded hole in a second head element. If additional fasteners are to be used, such as in FIG. 8, they are inserted through additional corresponding holes the first head element, shock absorbing element, handle, second shock absorbing element, and second head element. All fasteners should be tightened to secure the assembly for safe and extended use. If torque screws or bolts are used, a special tool may be needed to install or remove the fasteners. Alternatively, fasteners may extend through holes in the second head element and be secured with nuts. In this case, it may desirable to use lock washers between the head element and the nut. To replace a part of the hammer assembly, all fasteners are removed. The tool is then reassembled as described above with the new part.

The tool of the present invention can be used for any application requiring a striking or pulling tool with appropriate head elements. It is used in the normal way a conventional tool, such as a hammer, is used. For example, to use a hammer for pounding, the user grips the distal end of the handle and swings the hammer so that the strike face of the head impacts a nail or other object to be driven into a work piece. To remove a nail from a work piece, the user grips the distal end of handle, slides the claw along the nail to engage the nail between the claw, braces the end of the handle and the head against the work piece, and uses the handle as lever to apply pressure against the work piece and pull the nail out of the work piece.

The tool of the present invention has several advantages over previously known hammers and other striking and pulling tools. The head end of the handle is not split as in conventional hammers, hatchets, and axes with wooden handles, so the head end of the hammer of the present invention is stronger than head ends of conventional hammers, hatchets, and axes. One of the most common failure points of conventional hammers and axes is along the handle just below the head, due to damage from overstriking the intended targets and from using the hammer claw to nudge work pieces into position. The overstrike plates of the present invention, integrated with the head elements, protect the handle from these types of damage. Further, the overstrike plates provide for a more even distribution of the forces encountered while pulling nails or prying objects with the claw, as opposed to a traditional hammer head which concentrates these forces into a much smaller area of the handle promoting breakage by over-stressing the handle in this area. In addition, the proximal end of the handle, the head elements, and the shock absorbing elements may be formed into a rounded profile that facilitates sideways rotation in a direction perpendicular to the long dimension of the claw, such as for pulling nails from work pieces in confined spaces. Further, the rounded profile minimizes damage to the work piece surface when pulling nails in this manner.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. A tool for striking objects into a workpiece or pulling objects from a workpiece, the tool comprising:

a handle having a distal end and a proximal end with at least one hole passing through said proximal end, the hole sized and positioned to accommodate a fastening means;

a split head comprising two head elements on opposing sides of said proximal end of said handle, each head element having at least one aperture therein, with each aperture aligned with a hole passing through said handle; and fastening means passing between the apertures in said head elements and through the hole in said handle and securing said head elements to each other and to said proximal end of said handle.

2. The tool of claim 1, wherein said head elements have dimensions selected for a desired type of task.

3. The tool of claim 1, wherein said head elements and said handle have a smooth, rounded external profile.

4. The tool of claim 1, wherein at least one of said head elements comprises a strike face.

5. The tool of claim 1, wherein said tool is a hammer.

6. The tool of claim 1, wherein 1 of said head elements comprises a claw.

7. The tool of claim 1, wherein at least one of said head elements comprises an integrated overstrike plate adjacent said proximal end of said handle and extending along said handle toward said distal end.

8. The tool of claim 1, wherein said head elements are removable and separately replaceable.

9. The tool of claim 1, wherein said head elements are matched to provide a desirable weight distribution.

10. The tool of claim 1, further comprising at least one shock absorbing element between one of said head elements and said proximal end of said handle.

11. The tool of claim 10, wherein said shock absorbing element comprises a resilient material.

12. The tool of claim 10, wherein said shock absorbing element comprises a material selected from single durometer materials, a variable durometer materials, dual durometer materials, multi-durometer materials, and combinations thereof.

13. The tool of claim 10, wherein said head elements, said shock absorbing elements, and said handle have a smooth, rounded external profile.

14. The tool of claim 1, further comprising at least one weighting element between one of said head elements and said proximal end of said handle.

15. The tool of claim 1, wherein said fastening means is selected from screws, nuts, bolts, washers, torque screws, torque nuts, rivets, rivetless fasteners, internally threaded sleeves, welded pins, and combinations thereof.

16. A striking and pulling tool system, comprising:

at least one handle, each handle having a distal end and a proximal end having at least one hole therethrough for accommodating fastening means extending through said handle;

a plurality of head elements, each head element sized and shaped to fit against said proximal end of said handle opposing another of said head elements and comprising an overstrike plate shaped to fit against said handle and having at least one aperture therein, with each aperture positioned for alignment with a hole passing through said handle; and fastening means for insertion through the at least one hole in said handle and into the apertures in two of said head elements to secure said head elements to each other on opposing sides of said handle.

17. The tool system of claim 16, comprising a plurality of sets of paired head elements, wherein each pair of head elements has a complementary weight distribution.

18. The tool system of claim 16, wherein said head elements have shapes and sizes selected for a desired type of task.

19. The tool system of claim 16, further comprising a plurality of shock absorbing elements adapted to be positioned between said head elements and said handle.

20. The tool system of claim 16, wherein each of said head elements is designed for a different use.

21. A striking and pulling tool kit, comprising:

at least one handle, each handle having a distal end and a proximal end having at least one hole therethrough for accommodating fastening means extending through said handle;

a plurality of head elements, each head element sized and shaped to fit against said proximal end of said handle opposing another of said head elements and comprising an overstrike plate shaped to fit against said handle and having at least one aperture therein, with each aperture positioned for alignment with a hole passing through said handle; and fastening means for insertion through the at least one hole in said handle and into the apertures in two of said head elements to secure said head elements to each other on opposing sides of said handle.

22. The tool kit of claim 21, wherein said head element is selected from nail striking elements, mallet elements, and claw elements, wherein said overstrike plate includes at least one opening alignable with the opening in said handle to accommodate said fastening means.

23. The tool kit of claim 22, wherein said head element comprises a substantially planar or a convex strike face.

24. The tool kit of claim 22, wherein said head element comprises a strike face having a textured surface.

25. The tool system of claim 21, wherein said head elements and said handle can be assembled to form a tool having a smooth, rounded external profile.

26. The tool kit of claim 21, further comprising a plurality of shock absorbing elements positionable between said head elements and said handle.

* * * * *